US007083446B2

(12) United States Patent
Tanaka et al.

(10) Patent No.: US 7,083,446 B2
(45) Date of Patent: Aug. 1, 2006

(54) CONNECTOR FOR MEMORY CARD

(75) Inventors: Hirohisa Tanaka, Tsu (JP); Toshihiro Yamamoto, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/507,690

(22) PCT Filed: Dec. 26, 2003

(86) PCT No.: PCT/JP03/17082

§ 371 (c)(1),
(2), (4) Date: Sep. 22, 2004

(87) PCT Pub. No.: WO2004/059798

PCT Pub. Date: Jul. 15, 2004

(65) Prior Publication Data

US 2005/0221649 A1 Oct. 6, 2005

(30) Foreign Application Priority Data

Dec. 26, 2002 (JP) ..... 2002-377838

(51) Int. Cl.
*H01R 13/62* (2006.01)

(52) U.S. Cl. ..... 439/159; 439/155; 439/327

(58) Field of Classification Search ..... 439/159, 439/155, 327
See application file for complete search history.

(56) References Cited

U.S. PATENT DOCUMENTS 5,899,763 A * 5/1999 Kajiura ..... 439/159
6,065,984 A * 5/2000 Tung ..... 439/159
6,332,790 B1 * 12/2001 Ishikawa et al. ..... 439/157
6,390,836 B1 * 5/2002 Motegi et al. ..... 439/159
6,394,827 B1 * 5/2002 Nogami ..... 439/159
2002/0037658 A1 * 3/2002 Ozawa ..... 439/159
2002/0052131 A1 5/2002 Hashimoto

FOREIGN PATENT DOCUMENTS

JP 01-75983 5/1989

(Continued)

OTHER PUBLICATIONS

English Language Abstract of JP 2001-185286

(Continued)

*Primary Examiner*—Tulsidas C. Patel
*Assistant Examiner*—Vladimir Imas
(74) *Attorney, Agent, or Firm*—Greenblum & Bernstein, P.L.C.

(57) ABSTRACT

In a connector for memory card used in a mobile equipment, a locking mechanism of a memory card at a card lock position is integrally provided with a push-on/push-off mechanism constituted by a heart-shaped cam and a cam pin, so that the connector can be downsized. A heart-shaped cam groove unit is provided on a contact block fixed on a housing, and an end of a locking member is rotatably borne on a slider which can reciprocally be moved in an inside of the housing. The cam pin is provided on the other end of the locking member, and the cam pin is moved along the heart-shaped cam groove corresponding to reciprocal movement of the slider. Furthermore, a locking protrusion is provided on the locking member for protruding toward the memory card. The heart-shaped cam groove is formed in a manner so that not only the movement of the slider is locked but also the locking protrusion engages with a recess used to be locked provided on the memory card at a card lock position.

6 Claims, 15 Drawing Sheets

FOREIGN PATENT DOCUMENTS

| | | |
|---|---|---|
| JP | 2001-185286 | 7/2001 |
| JP | 3082883 | 10/2001 |
| JP | 2001-357929 | 12/2001 |
| JP | 2002-134224 | 5/2002 |

OTHER PUBLICATIONS

English Language Abstract of JP 2002-134224.
English Language Abstract of JP 2001-357929

* cited by examiner

CONNECTOR FOR MEMORY CARD

TECHNICAL FIELD

The present invention relates to a connector for memory card, which is connected to a memory card such as a mini-SD card so as to record and read out data with respect to the memory card.

BACKGROUND ART

In recent years, a mobile phone with a connector for memory card has been in practical use corresponding to popularization of a mobile phone with digital camera function. Such the mobile equipment is not only used in user's hand, but also pocketed and unpocketed with respect to a bag or a pocket of a cloth, frequently. Thus, a possibility that an external force due to dropping or the like is applied to the mobile equipment becomes higher corresponding to increase of the frequency of handling the mobile equipment.

A conventional connector for memory card shown, for example, in Publication Gazette of Japanese Utility Model Application 1-75983 has a locking mechanism for preventing dropout of a memory card by engaging a locking member with a recess used to be locked of the memory card at a card lock position in order to prevent the dropout of the memory card when an external force is applied, further to a push-on/push-off mechanism constituted by a hart-shaped cam and a guide pin.

On the other hand, it is required to downsize not only the memory card itself but also the connector for memory card in order to downsize the mobile equipment in which the connector for memory card is mounted. However, when a locking mechanism is provided further to a push-on/push-off mechanism, like the above-mentioned conventional connector for memory card, the connector itself cannot be downsized despite of downsizing of the memory card, so that it is difficult to downsize the mobile equipment furthermore.

DISCLOSURE OF INVENTION

The present invention is carried out to solve the above-mentioned problems and aimed to provide a connector for memory card, which can be downsized corresponding to the downsizing of the memory card.

For accomplishing the above-mentioned purpose, a connector for memory card in accordance with an aspect of the present invention comprises:

a box-shaped housing having a card insertion opening provided in a front portion through which a memory card is inserted;

a contact block provided in the vicinity of a rear end and in an inside of the housing and holding an alignment of a plurality of contacts which are to be contacted with I/O contacting terminals of the memory card in a manner so that contacting portions of the contacts are protruded toward the card insertion opening;

a slider provided between the contact block and the card insertion opening in the inside of the housing and slidable in a cross direction of the housing, having a contacting portion for contacting with a front end of the memory card inserted into the housing from the card insertion opening and arm portions for guiding side edges of the memory card, and siding with the memory card corresponding to a movement of the memory card;

a spring provided in the inside of the housing and constantly applying pressure to the slider toward the card insertion opening;

a hart-shaped cam groove unit provided in the inside of the housing and having a hart-shaped cam and a guide groove provided around the hart-shaped cam;

a locking member having a guide pin provided at an end thereof in a longitudinal direction and engaged with and slidable along the guide groove of the hart-shaped cam groove unit and a rotation shaft provided at the other end and rotatably borne by a bearing provided on a side portion of the slider, rotating around the rotation shaft owing to a movement of the guide pin along the guide groove corresponding to a movement of the slider in the cross direction, and locking the movement of the slider at a predetermined position by fitting the guide pin into a recess provided at a predetermined position on the hart-shaped cam when a pressing force applied to the memory card is released after moving the slider to an aftermost position in the cross direction of the housing; and a locking protrusion provided at an intermediate portion of the locking member in the cross direction of the housing, and engaging with a recess used to be locked provided on the memory card by protruding toward the memory card corresponding to the rotation of the locking member at the predetermined position where the movement of the slider is locked.

By such a configuration, since the hart-shaped cam groove unit is provided on the contact block fixed on the housing, it is possible to downsize the slider in comparison with the conventional connector in which the hart-shaped cam groove unit is provided on the slider. Furthermore, since the locking protrusion engaging with the recess used to be locked of the memory card for preventing the dropout is provided on the locking member locking the slider at the predetermined position, it is possible to make the constitution of the connector simple and to downsize the connector 1 (SIC) owing to reduce number of components in comparison with a case that a mechanism for locking the memory card is provided further to the push-on/push-off mechanism, like the conventional connector.

BEST MODE FOR CARRYING OUT THE INVENTION

Figure 1:
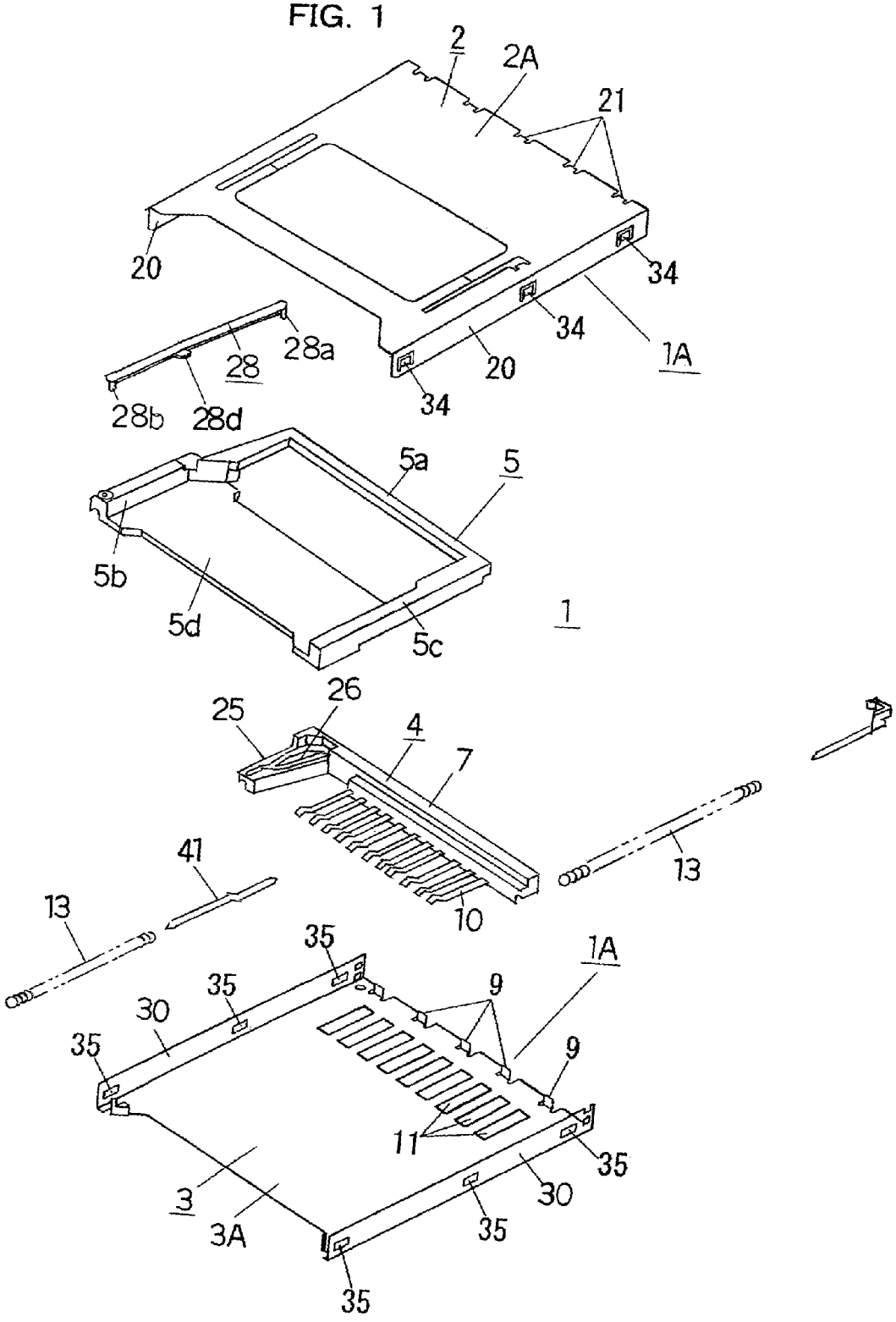
FIG. 1 is an exploded perspective view showing a constitution of a connector for memory card in accordance with an embodiment of the present invention.

A connector for memory card in accordance with an embodiment of the present invention is described. A constitution of a mini-SD card is described with reference to FIGS. 16A to 16E first, as an example of a memory card in this embodiment. It is needless to say that the present invention can be applied to another memory card other than the mini-SD card.

A memory card 100, which is called mini-SD card downsized from the conventional SD memory (SIC), has a thickness substantially the same as that of the conventional one but an outer shape thereof is one size smaller. As can be seen from the figures, the memory card 100 has substantially a flat rectangular shape, and a cutting portion 101 is provided at a corner of insertion side (front end) thereof. A recess 102 is formed on a bottom face in the insertion side of the memory card 100, and a plurality of (eleven in the case of the mini-SD card) I/O contact terminals 103 is aligned in the recess 102 in parallel with a widthwise direction. Upward offset portions 104 are respectively formed on both of left and right side edges in the insertion side of the memory card 100. Furthermore, recesses 105 used to be locked are respectively formed at positions backward (opposite side to the insertion side) from the cutting portion 101 on both of left and right side edges on an upper face of the memory card 100.

Subsequently, the connector for memory card (hereinafter, abbreviated as "connector 1") in accordance with this embodiment is described with reference to FIGS. 1 to 15.

As shown in FIG. 1, the connector 1 comprises a cover shell 2 which is formed by punching and bending a very thin stainless steel plate, and a base shell 3 which is similarly formed by punching and bending a very thin stainless steel plate. The base shell 3 has side walls 30 which are formed by bending both side portions of a bottom plate 3A upwardly (corresponding to an inside of a housing 1A), and front and rear ends of the base shell 3 is opened. A plurality of protruding pieces 9 is formed at a predetermined interval by bending the rear end of the base shell 3 upwardly. Similarly, the cover shell 2 has side walls 20 which are formed by bending both side portions of a ceil plate 2A downwardly (corresponding to the inside of the housing 1A). Furthermore, a plurality of protruding pieces 21 is formed at a predetermined interval by bending a rear end of the cover shell 2 downwardly. A housing 1A is constituted by overlaying the cover shell 2 on the base shell 3, which is flat and has a card insertion opening 3*a* (see FIG. 4A) formed on a front face through which the memory card 100 can be inserted. A plurality of holes 11 for threading contacts 10 and switching pieces 50*a* and 50*b* (see FIG. 10) held on a contact block 4 described below is formed at positions a little afore from the rear end of the bottom plate 3A of the base shell 3.

Figure 2:
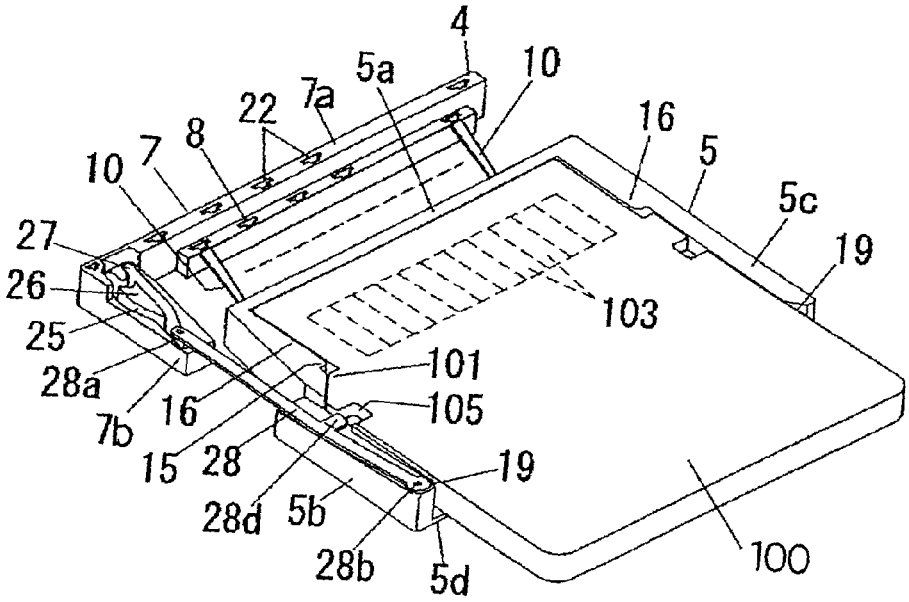
FIG. 2 is a perspective view showing an internal constitution under a condition that a slider moves to a card takeoff position in the above-mentioned connector for memory card.
Figure 3:
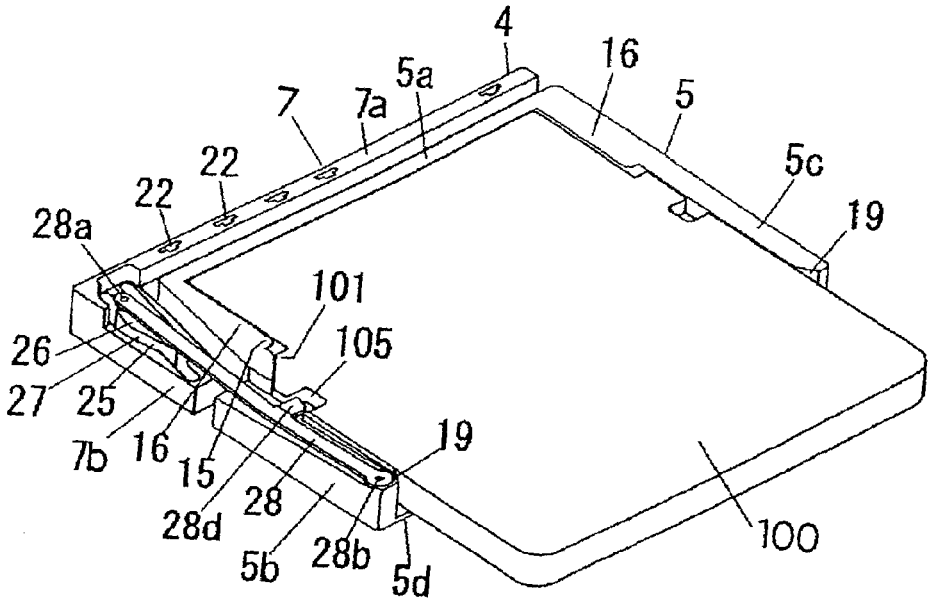
FIG. 3 is a perspective view showing a condition that the slider moves to a card set position.
Figure 4A:
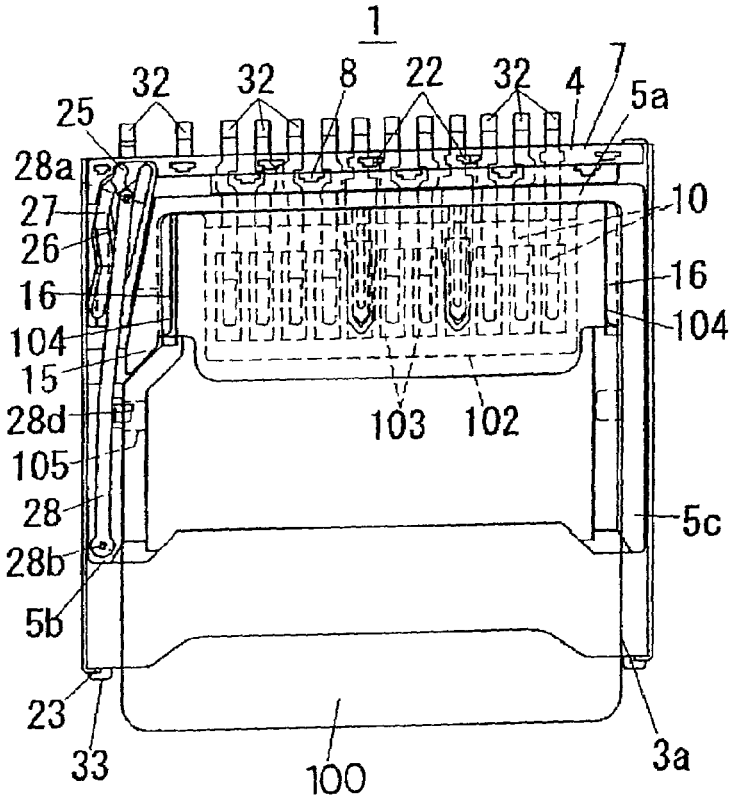
FIG. 4A, FIG. 4B and FIG. 4C are a plan view, a front view and a sectional side view of the connector for memory card in which a cover shell is removed under a condition that the slider moves to the card set position.
Figure 4C:
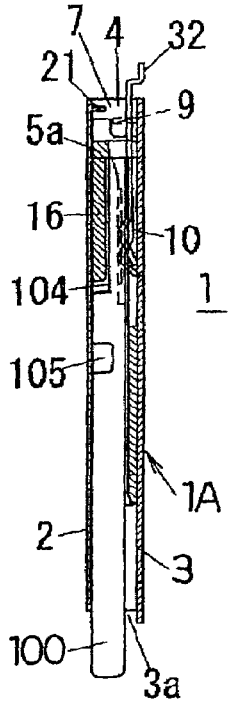
Figure 4B:
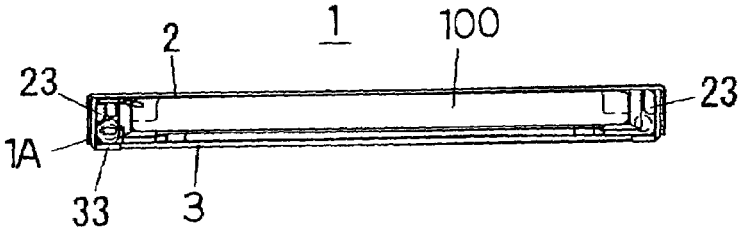

A contact block 4 and a slider 5 are contained in the inside of the housing 1A. The contact block 4 is fixed at a position in the vicinity of the rear end opposite to the card insertion opening 3*a* in the inside of the housing 1A. On the other hand, the slider 5 is slidable in a cross direction in the inside of the housing 1A. FIG. 2 shows a condition that the slider 5 moves to a card takeoff position, and FIG. 3 shows a condition that the slider 5 moves to a card set position. Furthermore, the connector 1, which is completed by mounting the contact block 4 and the slider 5 in the inside of the housing 1A, is shown in FIGS. 4A to 4C.

The contact block 4 is constituted by a base member 7 formed by resin molding, the contacts 10 and the switching pieces 50*a* and 50*b* (see FIG. 10) which are held on the base member 7 by insert molding, press fitting, or the like. The contacts 10 respectively contact with a plurality of the I/O contact terminals 103 aligned in parallel with the insertion side of the bottom face of the memory card 100. Furthermore, a pair of the switching pieces 50*a* and 50*b* is used for sensing a position of the memory card 100. Contacting sides of the contacts 10 and the switching pieces 50*a* and 50*b* are respectively protruded from the base member 7 toward the front face side (toward the card insertion opening 3*a*), and soldering terminals 32 which are to be soldered on a circuit board, or the like are respectively protruded toward a rear face side of the base member 7 (see FIG. 9).

Figure 5B:
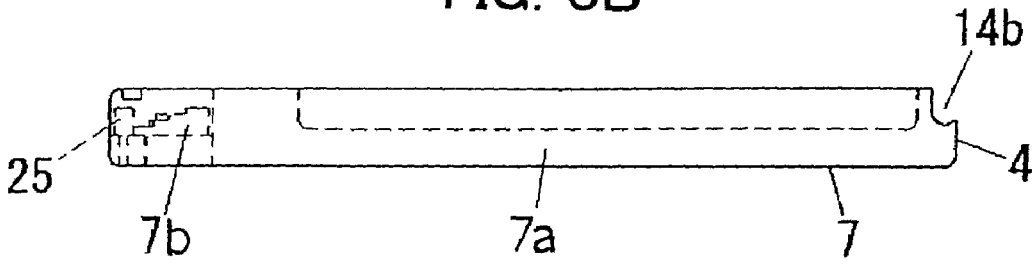
FIG. 5A, FIG. 5B and FIG. 5C are a plan view, a rear view and a right side view showing a constitution of a contact block of the connector for memory card.
Figure 5A:
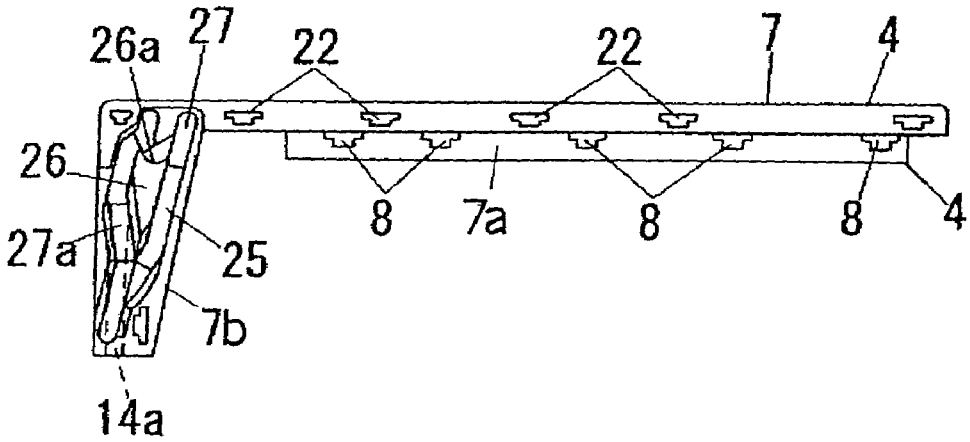
Figure 5C:
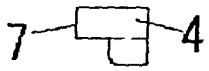

As shown in FIGS. 5A to 5C, the base member 7 is constituted by a main portion 7*a* extended in a widthwise direction of the housing 1 (SIC), and a protruding portion 7*b* protruded from an end (for example, left end) of the main portion 7*a* toward the card insertion opening 3*a* of the housing 1A. An offset portion is formed on a front face of the main portion 7*a* of the base member 7. A plurality of fitting holes 8, into which the protruding pieces 9 of the base shell 3 are press fitted from beneath, is formed in a manner to penetrate through the offset portion in a thickness direction of the housing 1A so as to have an opening thereon. A plurality of fitting holes 22, into which the protruding pieces 21 of the cover shell 2 are press fitted from above, is formed on the main portion 7*a* so as to have an opening on an upper face thereof. When the contact block 4 is disposed on the bottom plate 3A of the base shell 3 and the cover shell 2 is overlaid on the base shell 3 from the above, the protruding pieces 9 of the base shell 3 are press fitted into the fitting holes 8 from beneath, and the protruding pieces 21 of the cover shell 2 are press fitted into the fitting holes 22 from above, so that the housing 1A is formed and the contact block 4 is fixed on the housing 1A, simultaneously.

As shown in FIG. 1, a plurality of elastic hooking portions 34 is formed on both side walls 20 of the cover shell 2 by cutting and bending work in a manner so that a top end thereof turns upward. Furthermore, a plurality of hooking holes 35 is formed on the side walls 30 of the base shell 3 corresponding to the elastic hooking portions 34. When the cover shell 2 is overlaid on the base shell 3, the elastic hooking portions 34 are engaged with the hooking holes 35 so that the engagement of the cover shell 2 with the base shell 3 can be reinforced.

A hart-shaped cam groove unit 25 is formed on an upper face of the protruding portion 7*b* of the base member 7. The hart-shaped cam groove unit 25 is constituted by a hart-shaped cam 26 and a guide groove 27 formed around the hart-shaped cam 26. A guide pin 28*a* of a locking member 28 which will be described below is slidably engaged with the guide groove 27. The guide pin 28*a* moves along a predetermined path on the guide groove 27 being guided by side walls of the guide groove 27 and convex and concave faces formed on a bottom face 27*a* of the guide groove 27 corresponding to a movement of the slider 5 in the cross direction.

Figure 6B:
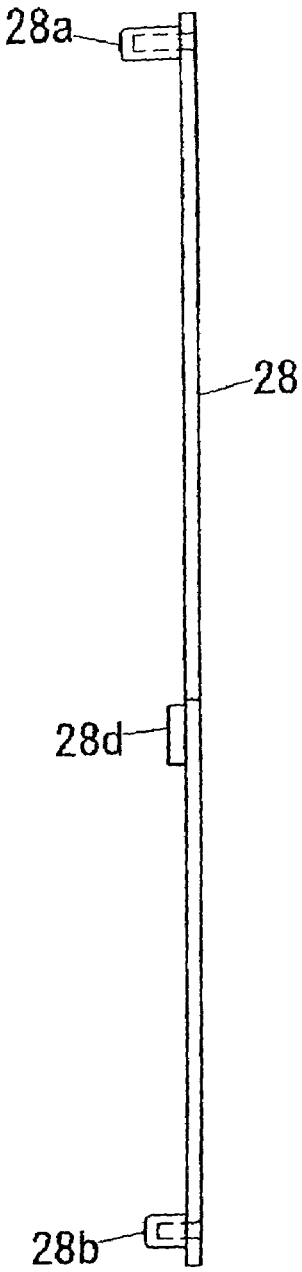
FIG. 6A, FIG. 6B and FIG. 6C are a front view, a side view and a sectional view showing a constitution of a locking member of the connector for memory card.
Figure 6A:
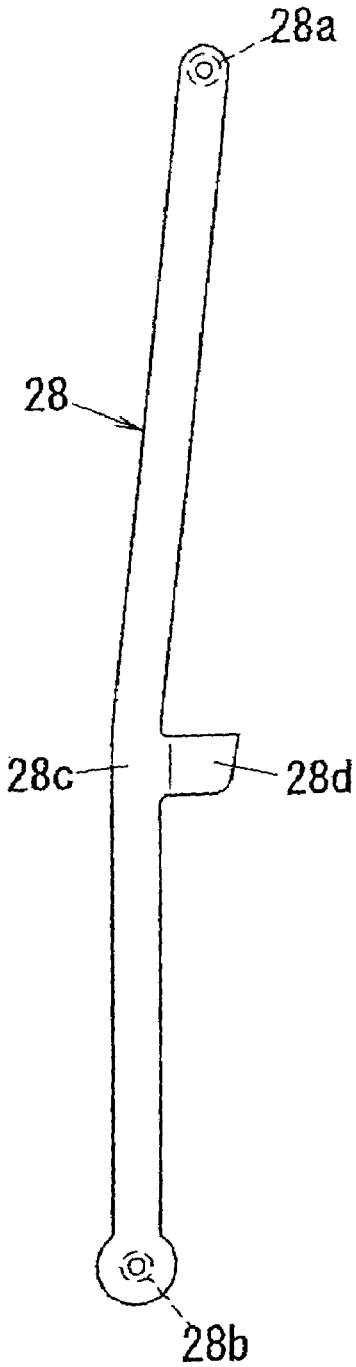
Figure 6C:
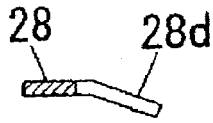

As shown in FIGS. 6A to 6C, the locking member 28 is formed of a narrow metal plate to have a doglegged shape observed from above. The guide pin 28*a* is provided at an end of the locking member 28, and a rotation shaft 28*b* is provided at the other end. Furthermore, a locking protrusion 28*d*, which is protruded obliquely downward, is integrally formed on an inner periphery (a side edge facing the memory card 100) of a flexion 28*c* of the locking member 28.

A cutting 14*a* is formed on a lower face in a front end portion of the protruding portion 7*b* of the base member 7 for averting an interference of a spring hook (not shown) provided on the base shell 3. Similarly, a cutting 14*b* is formed on a lower face in an end portion of the main portion 7*a* of the base member 7 opposite to the protruding portion 7*b* for averting an interference of another spring hook (not shown) provided on the base shell 3. Rear ends of coil springs 13, which will be described below, are inserted into the cuttings 14*a* and 14*b*, so that the rear ends of the coil springs 13 are held by the spring hooks.

Figure 7B:
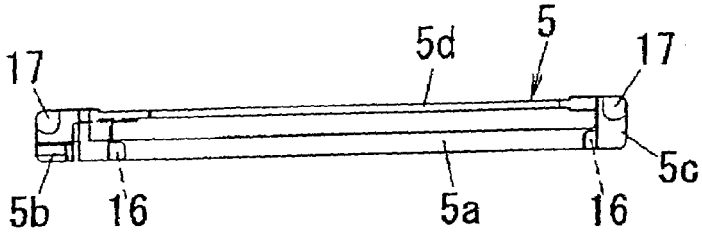
FIG. 7A, FIG. 7B, FIG. 7C and FIG. 7D are a plan view, a rear view, a front view and a right side view showing a constitution of a slider of the connector for memory card.
Figure 7A:
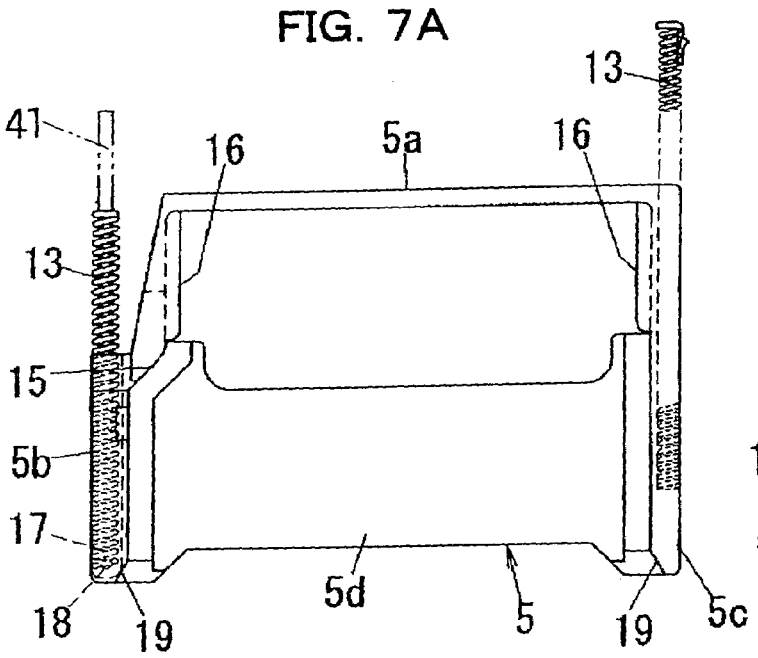
Figure 7D:
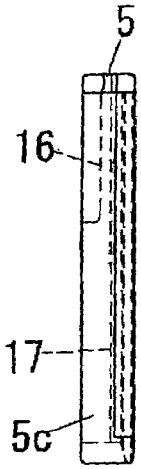
Figure 7C:
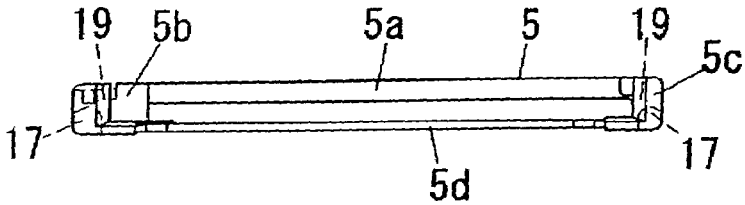

As shown in FIGS. 7A to 7D, the slider 5 is formed to have substantially a channel bar shape by resin molding, and has arm portions 5*b* and 5*c* for guiding left and right side edges of the memory card 100, a contacting portion 5*a* interconnecting between upper edges of rear portions of the arm portions 5*b* and 5*c* for contacting upper front portion of the memory card 100, and an interconnection piece 5*d* interconnecting between lower front edges of both arm portions 5*b* and 5*c*. As shown in FIG. 7A, inclined planes 19 are formed on inner faces in the vicinity of front ends of both arm portions 5*b* and 5*c* in a manner so that a distance between the inner faces is gradually expanded toward the front end.

One arm portion 5*b* is inflected outside at a portion substantially the center in the cross direction of the connector 1, and an inclined portion 15 is formed thereon so as to be contacted with the cutting portion 101 of the memory card 100. Furthermore, a bearing 18 is formed on an upper face in a front end portion of the arm portion 5*b* for bearing the rotation shaft 28*b* provided at an end of the locking member 28. The guide pin 28*a* at an end of the locking member 28 is slidably engaged with the guide groove 27, and the rotation shaft 28*b* at the other end is borne by the bearing 18. Thus, when the guide pin 28*a* moves around the hart-shaped cam 26 guided by the guide groove 27 corresponding to the movement of the slider 5 in the cross direction, the locking member 28 rotates around the rotation shaft 28*b*, so that the locking protrusion 28*d* moves in a widthwise direction corresponding to the rotation of the locking member 28.

Figure 10:
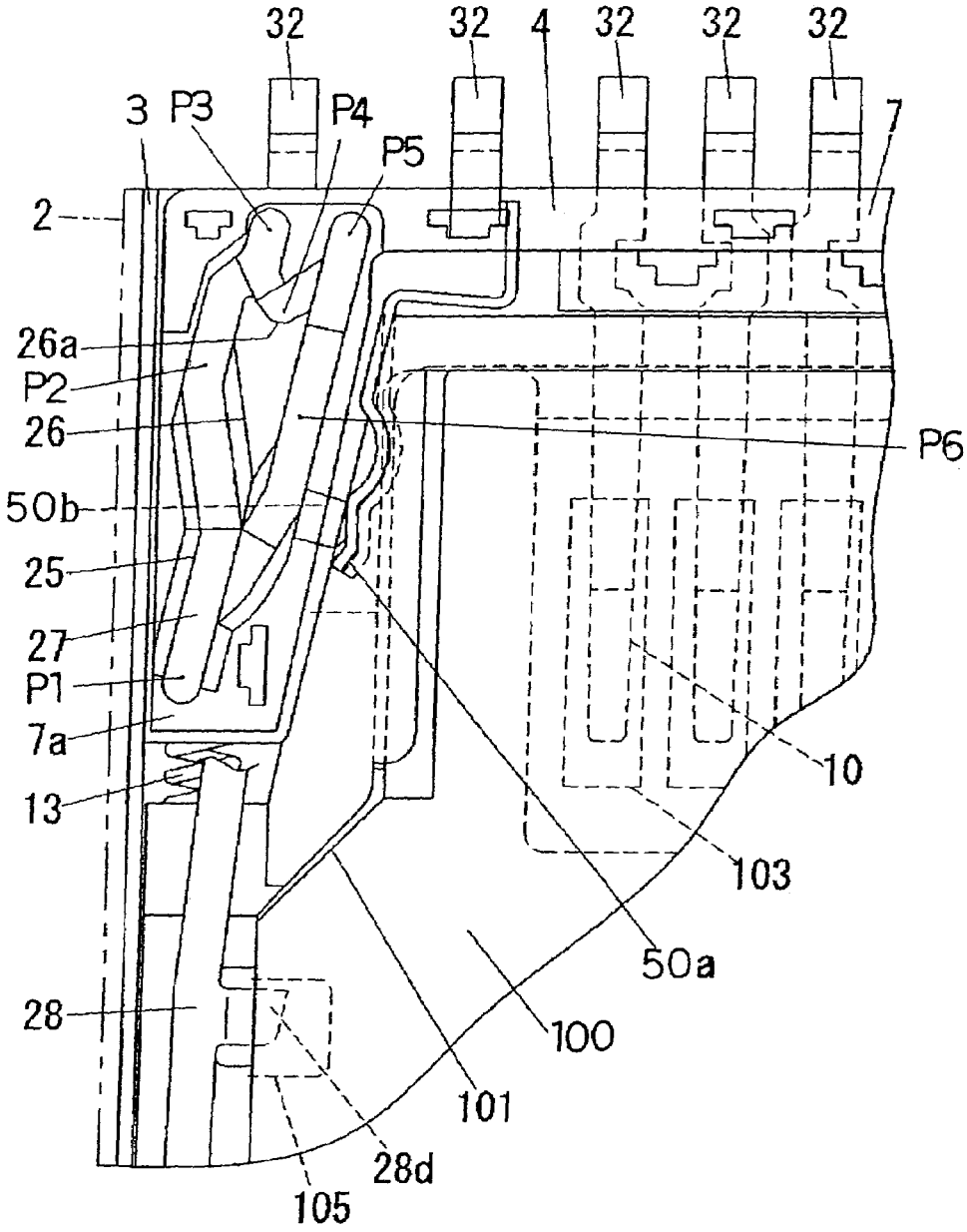
FIG. 10 is a plan view enlarging a main portion of the connector for memory card when the cover shell is removed.
Figure 11:
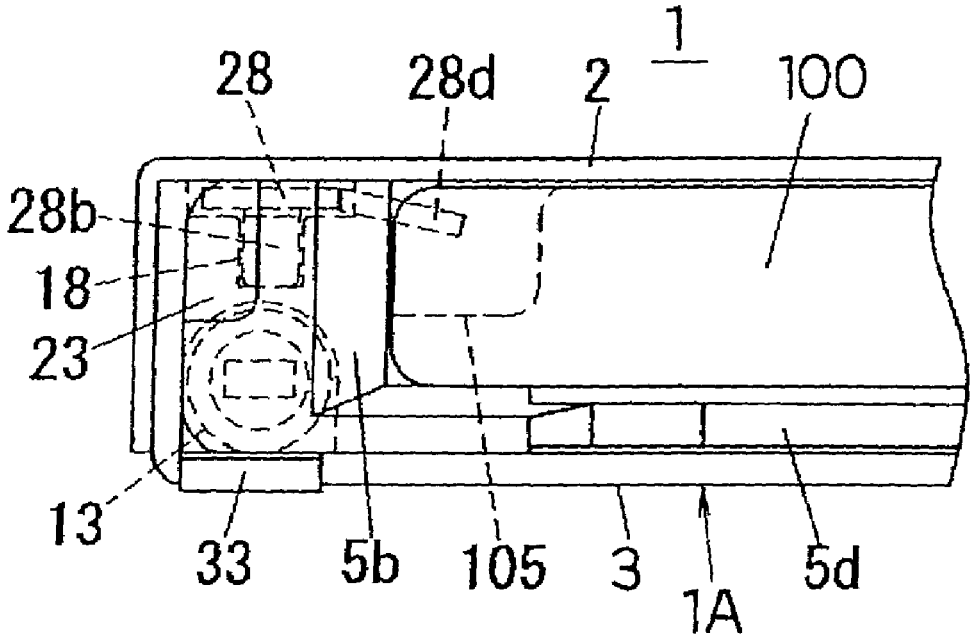
FIG. 11 is a front view of the connector for memory card in which a part of the connector is omitted.

With reference to FIG. 10, the guide groove 27 of the hart-shaped cam groove unit 25 is formed in a manner so that a line bound between an initial point P1 of the guide pin 28 when the slider 5 is positioned at the card insertion position and a point P4 of the guide pin 28*a* when the slider 5 is positioned at the card lock position (or a recess 26*a*) is not in parallel with the moving direction of the slider 5 (the cross direction of the housing 1A) and crosses at a predetermined angle thereto. Since the locking member 28 rotates around the rotation shaft 28*b* corresponding to the movement of the guide pin 28*a* in the guide groove 27, an area in which the locking member 28 can be rotated becomes larger than that in a case that the line bound between the points P1 and P4 were parallel to the moving direction of the slider 5. Consequently, an area in which the locking protrusion 28*d* moves corresponding to the rotation of the locking member 28 can be made larger.

Furthermore, guide rails 16, on which the upward offset portions 104 of the memory card 100 are disposed and the offset portions 104 slide, are formed on upper edges of the inside of the rear portion of the arm portions 5*b* and 5*c*. Still furthermore, substantially U-shaped narrow grooves 17, rear ends of which are opened, are formed on lower faces of the arm portions 5*b* and 5*c*. Front end portions of the coil springs 13 are contained in these narrow grooves 17, so that front ends of the narrow grooves 17 receive the pressure of the coil springs 13. Since both arm portions 5*b* and 5*c* receive the pressure of the coil springs (pressing springs) 13 evenly forward, the slider 5 can be moved smoothly in the cross direction in the inside of the housing 1A without inclination.

For assembling the connector 1 having the above-mentioned constitution in accordance with the embodiment, the contact block 4 is disposed at the rear end portion on the upper face of the base shell 3, first, and the protruding pieces 9 formed on the base shell 3 are press fitted into the fitting holes 8 of the contact block 4 from beneath, so that the contact block 4 is fixed on the base shell 3. Subsequently, spring guides 41 (see FIG. 7A) are press fitted to the base shell 3, so that the coil springs 13 are inserted thereto. Furthermore, the slider 5 is disposed on the base shell 3 in front of the contact block 4. At that time, the front portions of the coil springs 13 are engaged with the narrow grooves 17 formed on the rear side faces of the arm portions 5*b* and 5*c* of the slider 5. Subsequently, the rotation shaft 28*b* at an end of the locking member 28 is engaged with and borne by the bearing 18 formed on the leg (SIC) portion 5*b* of the slider 5, and the guide pin 28*a* at the other end of the locking member 28 is engaged with the guide groove 27.

Since the slider 5 is pressed by the coil springs 13, it is moved forward (toward the card insertion opening 3*a*), and the front ends of the arm portions 5*b* and 5*c* contact rear faces of protrusions 23 provided at front end of the base shell 3. Thus, the slider 5 is restricted to be moved forward no more. In such the condition, the guide pin 28*a* of the locking member 28 moves to the initial position P1 at the front end of the guide groove 27, and the locking protrusion 28*d* is evacuated from the recess 105 used to be locked (see FIG. 10).

After disposing the contact block 4 and the slider 5 on the base shell 3, and the coil springs 13 and the locking member 28 are mounted by this manner, the cover shell 2 is overlaid on the base shell 3 from above. At that time, the protruding pieces 21 formed on the cover shell 2 are press fitted into the fitting holes 22 on the base member 7 of the contact block 4, and the side walls 20 are moved downward along outer faces of the side walls 30 of the base shell 3. Upward front portions of the elastic hooking portions 34 formed on the side walls 20 of the base shell 2 are hooked by the hooking holes 35 correspondingly formed on the side walls 30 of the base shell 3. Thereby, the cover shell 2 and the base shell 3 are coupled with each other so that the box-shaped housing 1A, which is flat and has the card insertion opening 3*a* on the front portion, is completed. The connector 1 is further completed, simultaneously.

Hereupon, the connector 1 in accordance with this embodiment configures an SMD type connector, in which lower faces of soldering terminal portions 32 of the contacts 10 and the switching pieces 50*a* and 50*b* and lower faces of soldering portions 33 (see FIG. 11) used to be grounded and protruded forward from the front side edges of the base shell 3 are made lower. Furthermore, when the housing 1A of the connector 1 made of metal is grounded, it becomes tough with respect to static electricity and external noise.

Figure 8:
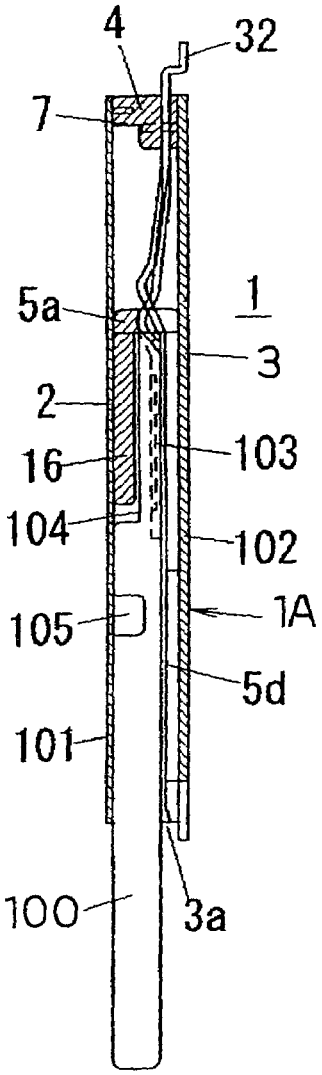
FIG. 8 is a sectional side view of the connector for memory card under a condition that the slider moves to a card takeoff position.
Figure 9:
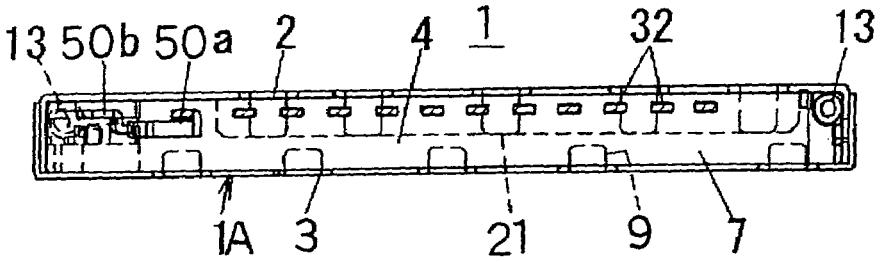
FIG. 9 is a rear view of the connector for memory card.
Figure 12B:
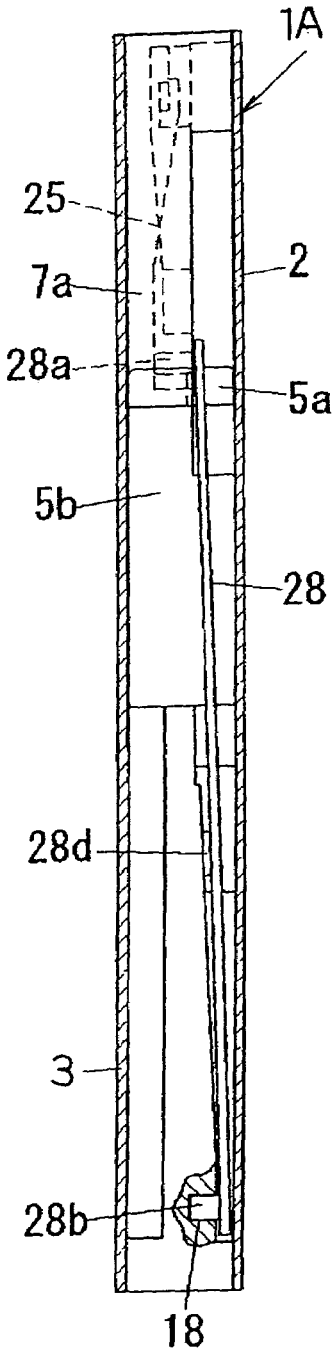
FIG. 12A and FIG. 12B are respectively a plan view and a sectional side view enlarging a portion in the vicinity of a locking member under an initial condition when a memory card is inserted into the connector for memory card.
Figure 12A:
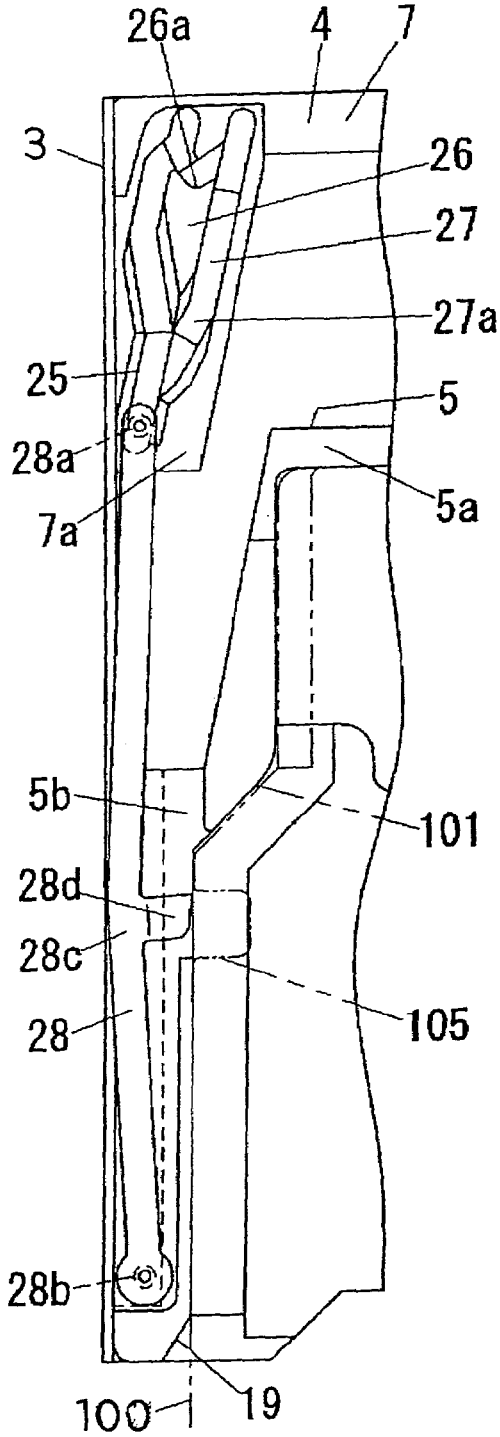
Figure 13:
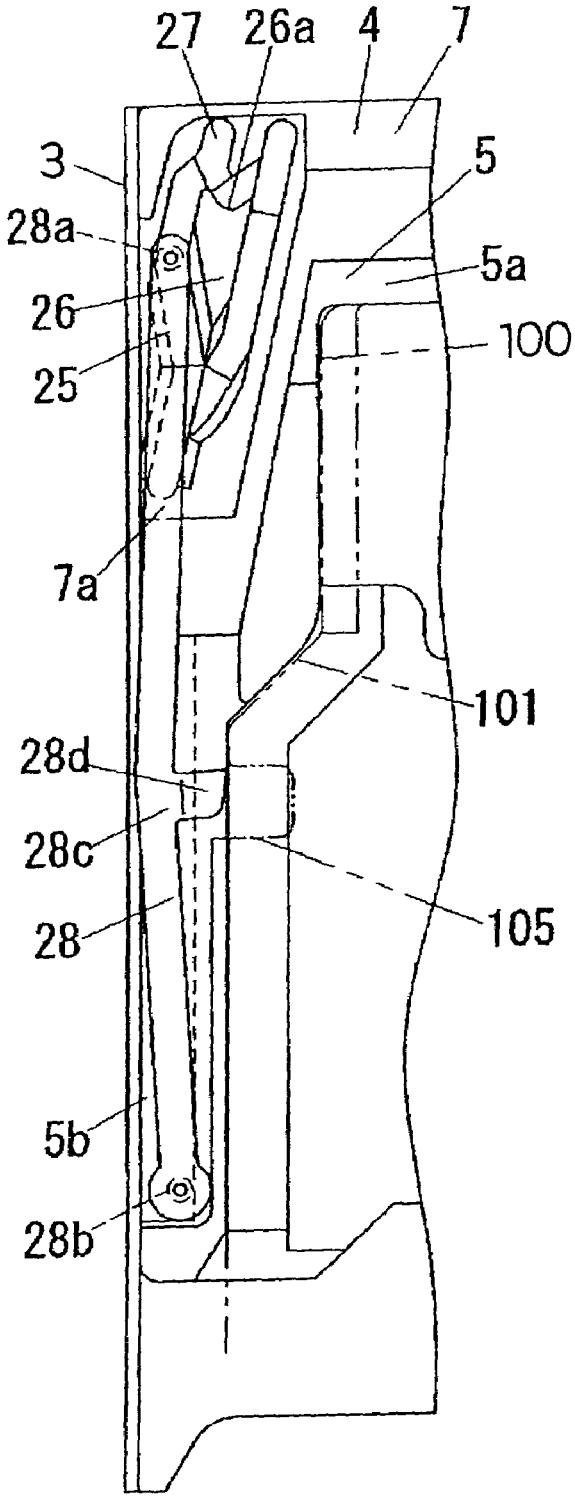
FIG. 13 is a plan view enlarging the portion in the vicinity of the locking member under a mid stream condition for inserting the memory card into the connector for memory card.

FIG. 8 is a sectional side view of the connector 1 under a condition that the memory card 100 has not been inserted. Under such the condition, the slider 5 is moved toward the card insertion opening 3*a* by receiving the pressure of the coil springs 13. At this time, as shown in FIG. 12A, the guide pin 28*a* of the locking member 28 is moved to the initial position P1 (see FIG. 12(*a*)) (SIC), so that it is moved to the most inside position in the guide groove 27 (the farthermost position from the memory card 100). Therefore, the locking member 28 has been rotated to the limit in counterclockwise direction around the rotation shaft 28*b*, and the locking protrusion 28*d* is evacuated from the recess 105 used to be locked.

Subsequently, motion of each section when the memory card 100 is inserted into the connector 1 is described. When the memory card 100 is regularly oriented with respect not only front and rear but also top and bottom and inserted into the housing 1A from the card insertion opening 3*a*, the front end of the memory card 100 is inserted between the arm portions 5*b* and 5*c* of the slider 5 in the inside of the housing 1A, and the downward (SIC) offset portions 104 on the bottom side portions of the memory card 100 contact the guide rails 16 of the slider 5. When the memory card 100 is further inserted into the inside of the housing 1A, the cutting portion 101 formed on a side in the vicinity of the front end of the memory card 100 contacts the slanted portion 15 on the arm portion 5*b* of the slider 5, and the front end of the memory card 100 further contacts the contacting portion 5*a* so as to push the slider 5 backward of the housing 1A. When the memory card 100 is further pushed against the pressure of the coil springs 13 applied to the slider 5, the slider 5 moves backward corresponding to the movement of the memory card 100. Corresponding to the backward movement of the slider 5, the guide pin 28*a* of the locking member 28 moves along the guide groove 27 of the hart-shaped cam groove unit 25 to a position P2 in the guide groove 27 at left hand of the hart-shaped cam 26 with being guided by the side walls and the convex and concave faces on the bottom 27*a* of the guide groove 27 (see FIGS. 10 and 13). At that time, the locking member 28 rotates around the rotation shaft 28*b* corresponding to the movement of the guide pin 28*a*. The guide groove 27, however, is elongated substantially straight in the cross direction at left hand of the hart-shaped cam 26, so that the inclination (rotation angle) of the locking member 28 is much smaller, and the locking protrusion 28*d* has not been engaged with the recess 105 of the memory card 100 used to be locked.

When the memory card 100 is further pushed near to a position at which a rear face of the contacting portion 5*a* of the slider 5 contacts a front face of the base member 7 of the contact block 4, the guide pin 28*a* of the locking member 28 reaches to a position P3 contacting the rear end of the guide groove 27 (see FIG. 10), so that it is impossible to push the memory card 100 no more. When the pressing force applied to the memory card 100 is released, the slider 5 returns a little forward with the memory card 100 by reaction force of the coil springs 13. The guide pin 28*a* of the locking member 28, however, moves to fit in the recess 26*a* of the hart-shaped cam 26 (at the position P4 in FIG. 10) with being guided by the guide groove 27, so that the slider 5 cannot be moved forward no more. Consequently, the memory card 100 is immovable in the connector 1 at the position (see FIGS. 14A and 14B).

When the front portion of the memory card 100 is moved to a predetermined position corresponding to be pushed, top ends of the contacts 10 serially contact with corresponding I/O contact terminals 103 formed on the bottom face of the memory card 100 corresponding to the length of the contacts 10. Furthermore, a front portion of the switching piece 50*a* protruded forward is pushed by a side face of the cutting portion 101 of the memory card 100 so as to contact with the other switching piece 50*b*, so that a switch is turned on (see FIG. 10). It is possible to sense that the memory card 100 has been inserted at a regular position by an external sensing circuit (not shown) with using a signal from the switch.

Figure 14B:
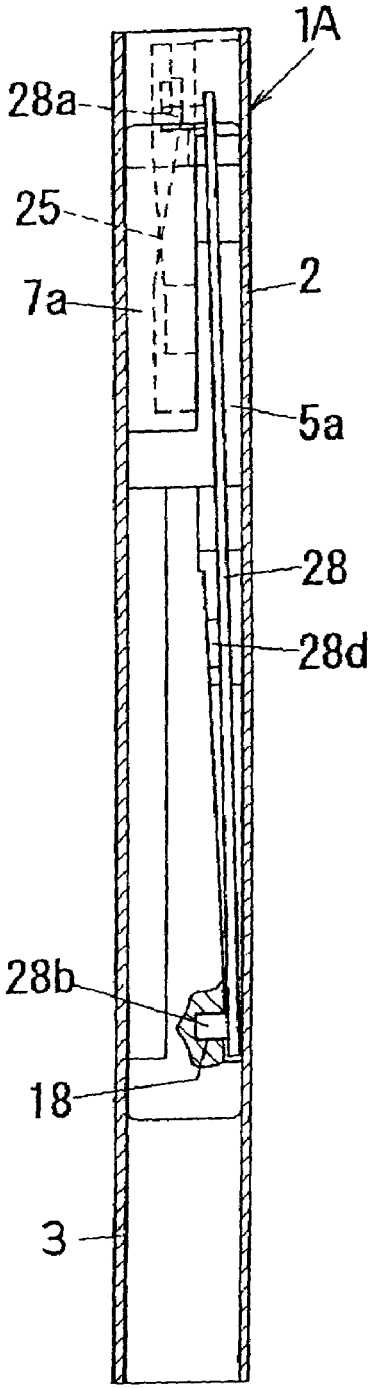
FIG. 14A and FIG. 14B are respectively a plan view and a sectional side view enlarging the portion in the vicinity of the locking member under a condition that the memory card is inserted to a card set position of the connector for memory card.
Figure 14A:
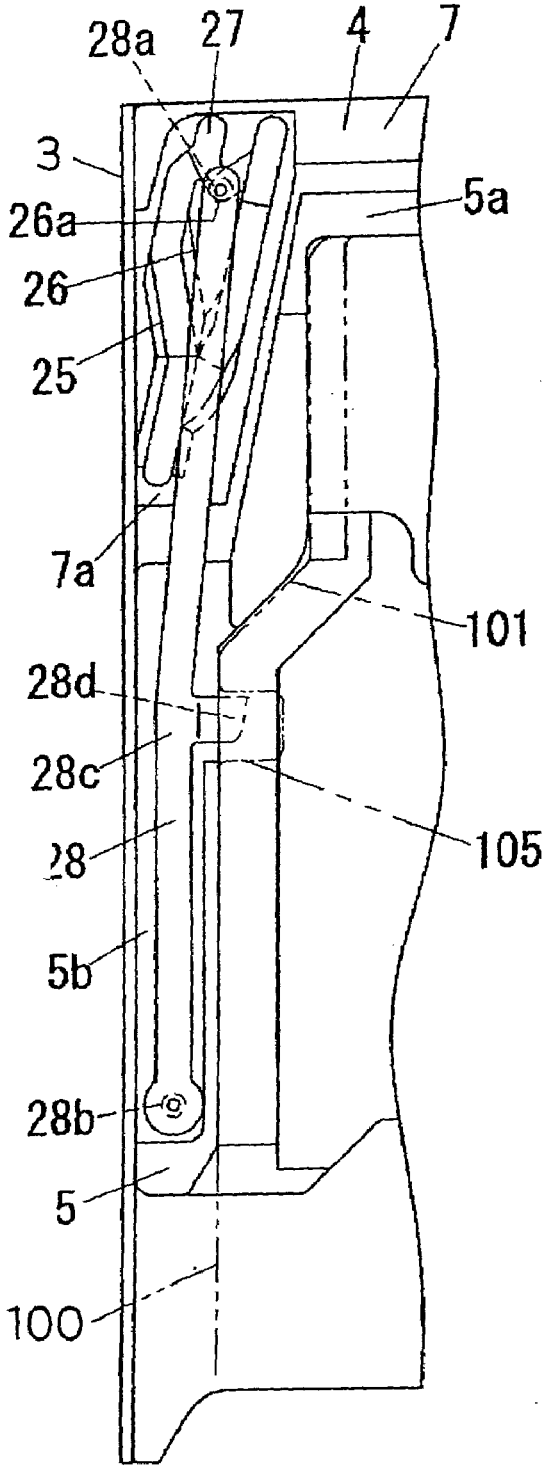
Figure 15:
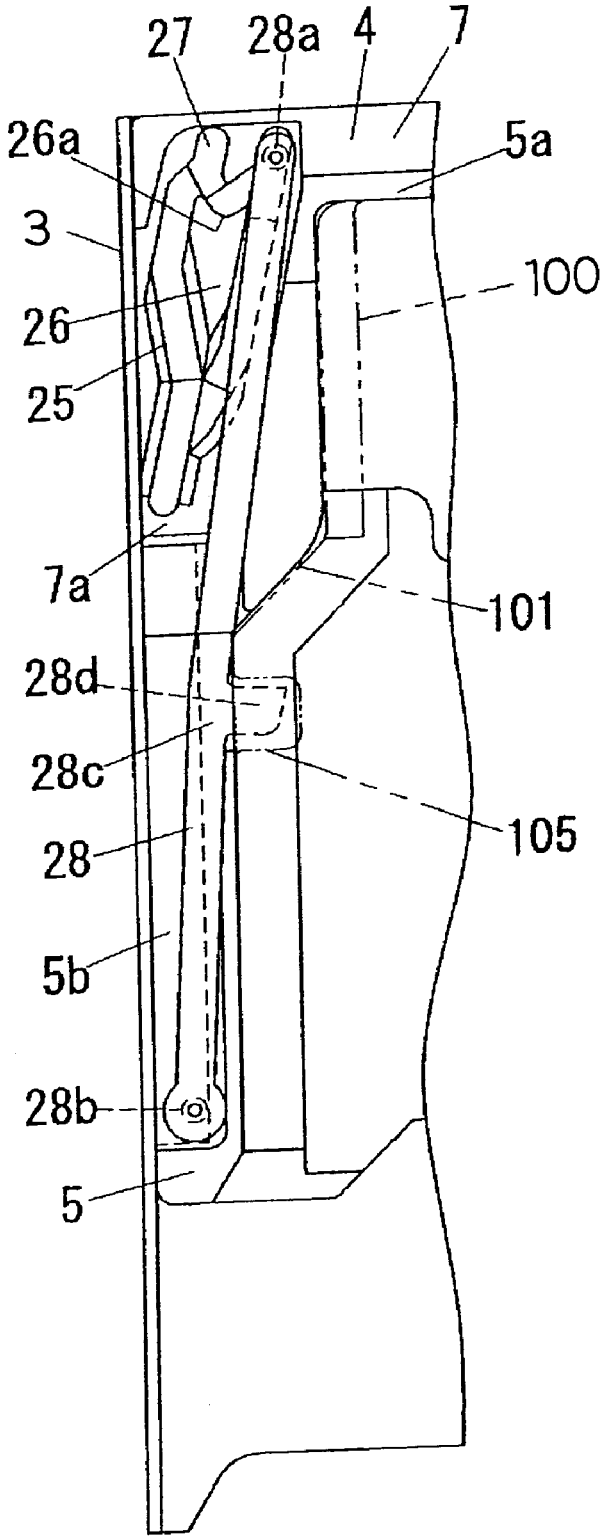
FIG. 15 is a plan view enlarging the portion in the vicinity of the locking member under a mid stream condition for taking out the memory card from the connector for memory card.
Figure 16A:
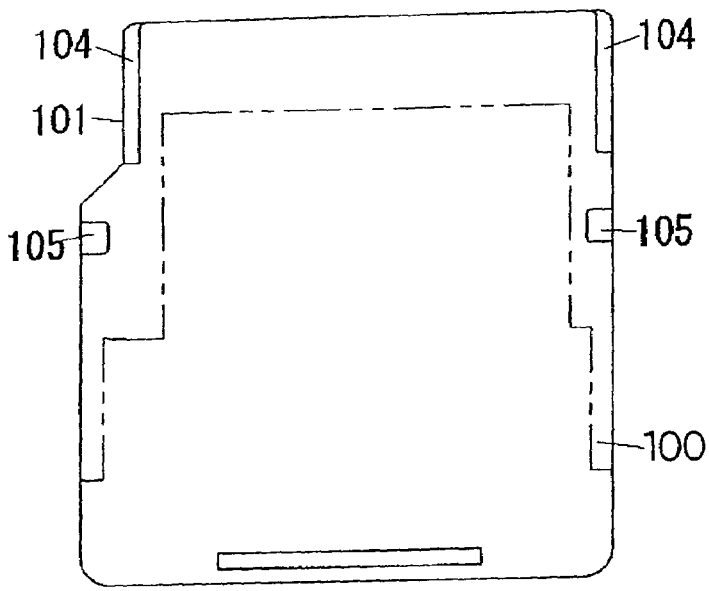
FIG. 16A, FIG. 16B, FIG. 16C, FIG. 16D and FIG. 16E are respectively a plan view, a right side view, a bottom view, a rear view and a front view showing a constitution of a mini-SD card which is an example of a memory card.
Figure 16B:
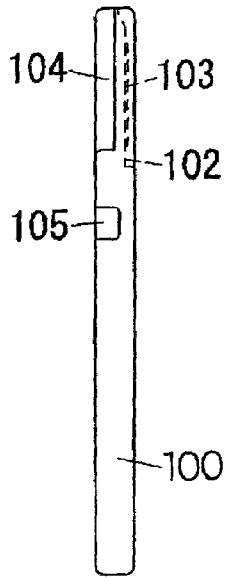
Figure 16C:
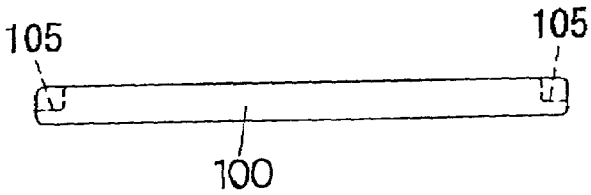
Figure 16E:
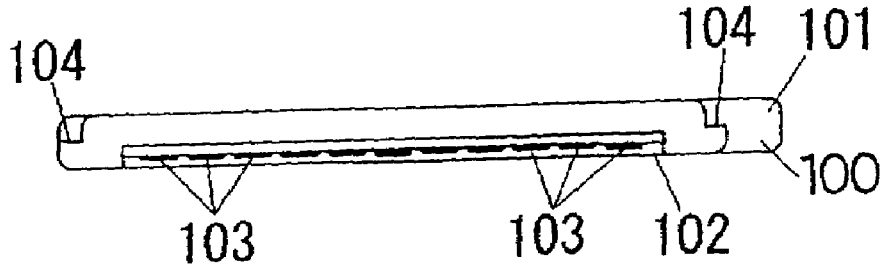
Figure 16D:
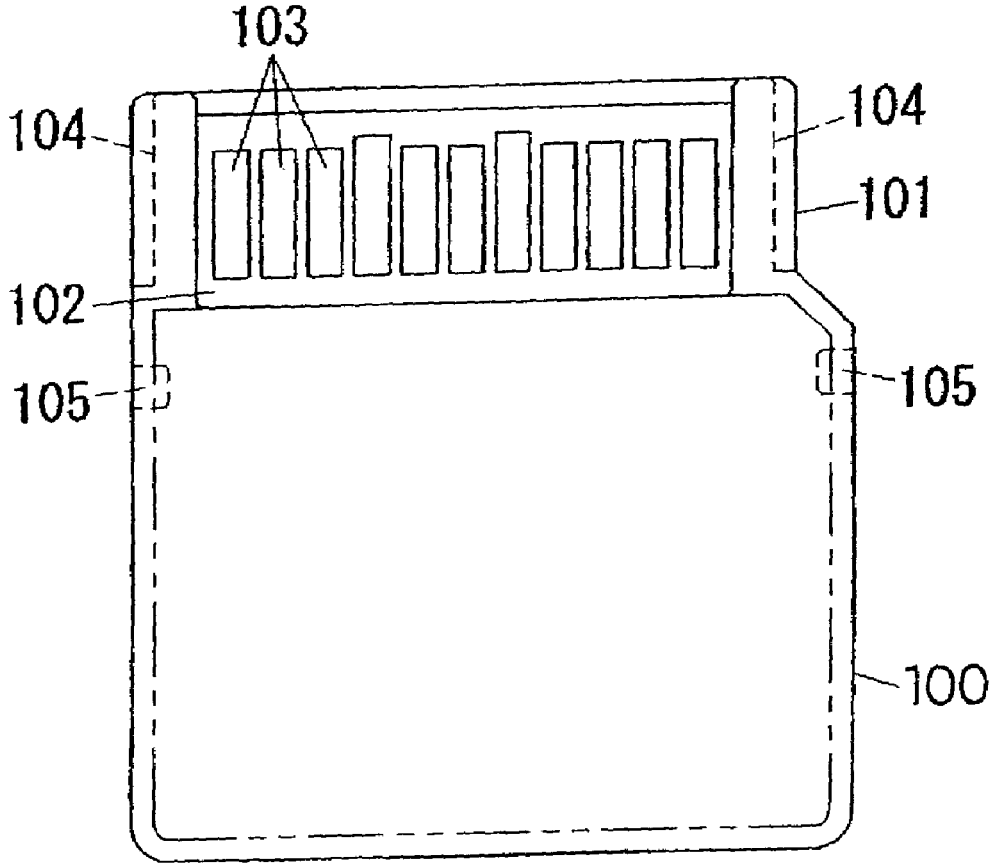

Even though the movement of the slider 5 is restricted by fitting the guide pin 28*a* of the locking member 28 into the recess 26*a* of the hart-shaped cam 26, there is a possibility that the memory card 100 is dropped out from the connector 1 when an external force is applied to the connector 1, if there is no locking means. In this embodiment, when the slider 5 moves to the card lock position, the locking protrusion 28*d* of the locking member 28, which is rotated corresponding to the movement of the slider 5 in the cross direction, protrudes inward from the arm portion 5*b* (toward the memory card 100), and a top end thereof engages with the recess 105 of the memory card 100 used to be locked, so that the memory card 100 is locked. FIG. 14A shows such the condition. Since the locking protrusion 28*d* is constituted in a manner so that about a half thereof is engaged with the recess 105 used to be locked, the engagement of the locking protrusion 28*d* and the recess 105 used to be locked can easily be released, even when a force is applied to the memory card 100 forcibly taken off. Thus, the damage of the locking member 28 can be prevented.

In order to take off the memory card 100 inserted as just described from the connector 1, the rear end of the memory card 100 protruded from the card insertion opening 3*a* of the housing 1A is pushed in an insertion direction, so that the memory card 100 is moved in the insertion direction with the slider 5. The guide pin 28*a* of the locking member 28 departs from the recess 26*a* of the hart-shaped cam 26 corresponding to this movement, and moves along the guide groove 27 to a position P5 in the guide groove 27 disposed at right hand of the recess 26*a*. At that time, the locking member 28 is rotated in clockwise direction around the rotation shaft 28*b*, so that the locking protrusion 28*d* further moves toward the memory card 100, and the locking protrusion 28*d* substantially entirely enters into the recess 105 used to be locked.

When the pressing force applied to the memory card 100 is released, the slider 5 moves forward owing to the pressure of the coil springs 13. Corresponding to this movement, the guide pin 28*a* of the locking member 28 moves along a groove P6 in the guide groove 27 at right hand of the hart-shaped cam 26 with being guided by the side walls and the bottom faces of the guide groove 27 (see FIG. 10). Accordingly, the locking member 28 rotates in counter-clockwise direction around the rotation shaft 28*b*, so that the locking protrusion 28*d* is evacuated from the recess 105 used to be locked. The slider 5 moves toward the card insertion opening 3*a* owing to the pressure of the coil springs 13, and returns to the initial position P1 shown in FIG. 12. Consequently, the locking protrusion 28*d* is evacuated from and out of the recess 105 used to be locked, so that the lock of the memory card 100 is released. At that time, the rear portion of the memory card 100 is largely protruded outward from the card insertion opening 3*a* of the connector 1, the memory card 100 can easily be taken off from the connector 1.

As mentioned above, according to the constitution of the connector 1 in accordance with this embodiment, the hart-shaped cam groove unit 25 is provided on the contact block 4 which is to be fixed on the housing 1A, the slider 5 can be made smaller in comparison with the case that the hart-shaped cam groove unit is provided on the slider like the conventional connector. Furthermore, the locking protrusion 28*d* for preventing the dropout of the memory card 100 owing to engagement with the recess 105 used to be locked is provided on the locking member 28 for locking the slider 5 at the predetermined position, so that the constitution of the connector 1 can be made simple and the connector 1 can be downsized owing to reduction of number of components in comparison with the case that the mechanism for locking the memory card is provided further to the push-on/push-off mechanism like the conventional connector.

Furthermore, the slider 5 is formed substantially channel bar shape by the contacting portion 5*a* and the arm portions 5*b* and 5*c* which are protruded forward from both ends of the contacting portion 5*a*, so that the side edges of the memory card 100 can be guided by the arm portions 5*b* and 5*c* of the slider 5.

Still furthermore, the arm portions 5*b* and 5*c* are pressed by two coil springs 13 toward the card insertion opening 3*a* of the housing 1A, so that the slider 5 is pressed evenly and can be moved smoothly in the cross direction in the inside of the housing 1A.

Still furthermore, only a part of the locking protrusion 28*d* is engaged with the recess 105 of the memory card 100 used to be locked at the card lock position, so that the engagement of the locking protrusion 28*d* and the recess 105 used to be locked can easily be released, even when a force is applied to the memory card 100 forcibly taken off. Thus, the damage of the locking member 28 can be prevented.

Still furthermore, the hart-shaped cam groove unit 25 is provided on the upper face of the base member 7 of the contact block 4, so that the locking member 28 rotates in a plane substantially parallel to the ceil face 2A and the bottom face 3A (SIC) of the housing 1A. Consequently, the height (or thickness) of the housing 1A can be made lower (or thinner).

Still furthermore, the guide groove 27 of the hart-shaped cam groove unit 25 is formed in a manner so that the line bound between the initial point P1 of the guide pin 28 when the slider 5 is positioned at the card insertion position and the point P4 of the guide pin 28*a* when the slider 5 is positioned at the card lock position (or a recess 26*a*) is not in parallel with the moving direction of the slider 5 (the cross direction of the housing 1A) and crosses at a predetermined angle thereto, so that the area in which the locking member 28 can be rotated becomes larger corresponding to the movement of the guide pin 28*a* in the guide groove 27. Consequently, the area in which the locking protrusion 28*d* moves corresponding to the rotation of the locking member 28 can be made larger.

This application is based on Japanese patent application 2002-377838 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

INDUSTRIAL APPLICABILITY

As mentioned above, since the connector for memory card in accordance with the present invention has a locking mechanism of the memory card, it is possible to prevent the dropout of the memory card even when an external force is applied due to dropping, further to the downsizing of the connector corresponding to the downsizing of the memory card. Thus, it can be used in an equipment having high possibility to be dropped such as a mobile equipment.

The invention claimed is:

1. A connector for memory card comprising:

a box-shaped housing having a card insertion opening provided in a front portion through which a memory card is inserted;

a contact block provided in the vicinity of a rear end and in an inside of the housing and holding an alignment of a plurality of contacts which are to be contacted with I/O contacting terminals of the memory card in a manner so that contacting portions of the contacts are protruded toward the card insertion opening;

a slider provided between the contact block and the card insertion opening in the inside of the housing and slidable in a cross direction of the housing, having a contacting portion for contacting with a front end of the memory card inserted into the housing from the card insertion opening and arm portions for guiding side edges of the memory card, and siding with the memory card corresponding to a movement of the memory card;

a spring provided in the inside of the housing and constantly applying pressure to the slider toward the card insertion opening;

a heart-shaped cam groove unit provided in the inside of the housing and having a heart-shaped cam and a guide groove provided around the heart-shaped cam;

a locking member having a guide pin provided at an end thereof in a longitudinal direction and engaged with and slidable along the guide groove of the heart-shaped cam groove unit and a rotation shaft provided at the other end and rotatably borne by a bearing provided on a side portion of the slider, rotating around the rotation shaft owing to a movement of the guide pin along the guide groove corresponding to a movement of the slider in the cross direction, and locking the movement of the slider at a predetermined position by fitting the guide pin into a recess provided at a predetermined position on the heart-shaped cam when a pressing force applied to the memory card is released after moving the slider to an aftermost position in the cross direction of the housing; and a locking protrusion provided at an intermediate portion of the locking member in the cross direction of the housing, engaging with a recess used to be locked provided on the memory card by protruding toward the memory card corresponding to the rotation of the locking member at the predetermined position where the movement of the slider is locked, and evacuated from and out of the recess at an initial position where the lock of the memory card is released.

2. The connector for memory card in accordance with claim 1, wherein the contacting portion of the slider is substantially in parallel with an alignment of the contacts of the contact block, and the arm portions are respectively protruded toward the card insertion opening of the housing from both ends of the contacting portion.

3. The connector for memory card in accordance with claim 2, wherein the spring is a coil spring, and provided at two positions respectively for pressing the arm portions toward the card insertion opening.

4. The connector for memory card in accordance with claim 1, wherein only a part of the locking protrusion is engaged with the recess used to be locked of the memory card at the predetermined position at which movement of the slider is locked.

5. The connector for memory card in accordance with claim 1, wherein the heart-shaped cam groove unit is provided on an upper face of the contact block.

6. The connector for memory card in accordance with claim 1, wherein the guide groove of the heart-shaped cam groove unit is formed in a manner so that a line bound between an initial point of the guide pin when the slider is positioned at a card insertion position and a point of the guide pin when the slider is positioned at a card lock position is not in parallel with a moving direction of the slider and crosses at a predetermined angle thereto.

* * * * *